US011391162B2

(12) United States Patent
Sobanski et al.

(10) Patent No.: US 11,391,162 B2
(45) Date of Patent: Jul. 19, 2022

(54) SPAR WITH EMBEDDED PLENUM PASSAGE

(71) Applicant: RAYTHEON TECHNOLOGIES CORPORATION, Farmington, CT (US)

(72) Inventors: Jon E. Sobanski, Glastonbury, CT (US); Howard J. Liles, Newington, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/122,017

(22) Filed: Dec. 15, 2020

(65) Prior Publication Data

US 2022/0186620 A1 Jun. 16, 2022

(51) Int. Cl.
*F01D 5/18* (2006.01)
*F01D 25/12* (2006.01)

(52) U.S. Cl.
CPC ..... *F01D 5/187* (2013.01); *F01D 25/12* (2013.01); *F05D 2220/32* (2013.01); *F05D 2260/201* (2013.01)

(58) Field of Classification Search
CPC ..... F01D 5/188
See application file for complete search history.

(56) References Cited

U.S. PATENT DOCUMENTS

| | | | | |
|---|---|---|---|---|
| 8,500,405 | B1 | 8/2013 | Jones et al. | |
| 8,511,975 | B2 * | 8/2013 | Shi | F01D 25/246 415/173.1 |
| 9,850,763 | B2 * | 12/2017 | Itzel | F01D 9/041 |
| 10,053,996 | B2 * | 8/2018 | Spangler | F01D 9/02 |
| 10,738,636 | B2 | 8/2020 | O'Leary | |
| 2015/0285096 | A1 | 10/2015 | Spangler et al. | |
| 2019/0032493 | A1 | 1/2019 | Barker et al. | |

FOREIGN PATENT DOCUMENTS

| | | |
|---|---|---|
| EP | 1154124 | 11/2001 |
| JP | 2004257389 | 9/2004 |

OTHER PUBLICATIONS

European Search Report for European Patent Application No. 21213170.0 dated Mar. 23, 2022.

* cited by examiner

*Primary Examiner* — Ninh H. Nguyen
*Assistant Examiner* — John S Hunter, Jr.
(74) *Attorney, Agent, or Firm* — Carlson, Gaskey & Olds, P.C.

(57) ABSTRACT

A spar for a vane arc segment of a gas turbine engine includes an elongated spar leg that has a spar wall that circumscribes a core passage. There is a plenum passage embedded in the spar wall between inner and outer portions of the spar wall. The inner portion of the spar wall is fully solid such that the plenum passage is fluidly isolated from the core passage. The outer portion of the spar wall has a plurality of cooling through-holes for emitting cooling air from the plenum passage.

23 Claims, 3 Drawing Sheets

SPAR WITH EMBEDDED PLENUM PASSAGE

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A spar for a vane arc segment of a gas turbine engine according to an example of the present disclosure includes an elongated spar leg that has a spar wall that circumscribes a core passage, and a plenum passage embedded in the spar wall between inner and outer portions of the spar wall. The outer portion of the spar wall has a plurality of cooling through-holes for emitting cooling air from the plenum passage.

In a further embodiment of any of the foregoing embodiments, the inner portion of the spar wall is fully solid such that the plenum passage is fluidly isolated from the core passage, and the plurality of cooling holes are exclusive outlets from plenum passage.

In a further embodiment of any of the foregoing embodiments, the spar leg includes ribs in the plenum passage that connect the inner and outer portions of the spar wall.

In a further embodiment of any of the foregoing embodiments, the ribs segregate the plenum passage into radial zones.

In a further embodiment of any of the foregoing embodiments, the ribs segregate the plenum passage into circumferential zones.

In a further embodiment of any of the foregoing embodiments, at least one of the ribs includes a through-hole.

A further embodiment of any of the foregoing embodiments includes a spar platform from which the spar leg extends, the spar platform having a cooling passage, and one of the ribs segregates the plenum passage from the cooling passage.

In a further embodiment of any of the foregoing embodiments, the ribs segregate the plenum passage into zones and define a manifold passage that interconnects the zones.

A vane arc segment for a gas turbine engine according to an example of the present disclosure includes an airfoil section that has an airfoil wall that defines a leading edge, a trailing edge, a pressure side, and a suction side. The airfoil section has an internal cavity, and a spar extends through the internal cavity for supporting the airfoil section. The spar is spaced from the airfoil wall. The spar has an elongated spar leg including a spar wall that circumscribes a core passage, and a plenum passage embedded in the spar wall between inner and outer portions of the spar wall. The outer portion of the spar wall has a plurality of cooling through-holes for emitting cooling air from the plenum passage toward the airfoil wall.

In a further embodiment of any of the foregoing embodiments, the inner portion of the spar wall is fully solid such that the plenum passage is fluidly isolated from the core passage, and the plurality of cooling holes are exclusive outlets from plenum passage.

In a further embodiment of any of the foregoing embodiments, the spar leg includes ribs in the plenum passage that connect the inner and outer portions of the spar wall.

In a further embodiment of any of the foregoing embodiments, the ribs segregate the plenum passage into radial zones.

In a further embodiment of any of the foregoing embodiments, the ribs segregate the plenum passage into circumferential zones.

In a further embodiment of any of the foregoing embodiments, at least one of the ribs includes a through-hole.

A further embodiment of any of the foregoing embodiments includes a spar platform from which the spar leg extends, the spar platform having a cooling passage, and one of the ribs segregates the plenum passage from the cooling passage.

In a further embodiment of any of the foregoing embodiments, the ribs segregate the plenum passage into zones and define a manifold passage that interconnects the zones.

In a further embodiment of any of the foregoing embodiments, the airfoil wall is ceramic and also defines first and second platforms.

A gas turbine engine according to an example of the present disclosure includes a compressor section, a combustor in fluid communication with the compressor section, and a turbine section in fluid communication with the combustor. The turbine section has vane arc segments disposed about a central axis of the gas turbine engine. The vane arc segments are as in any of the foregoing embodiments.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
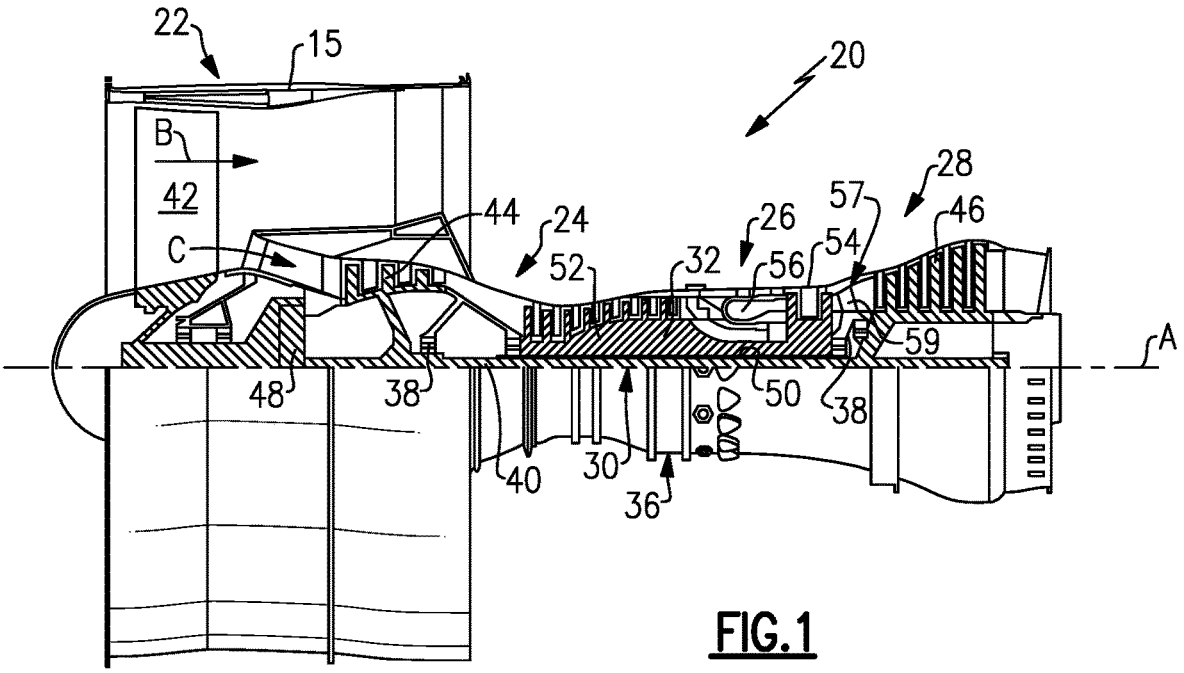
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
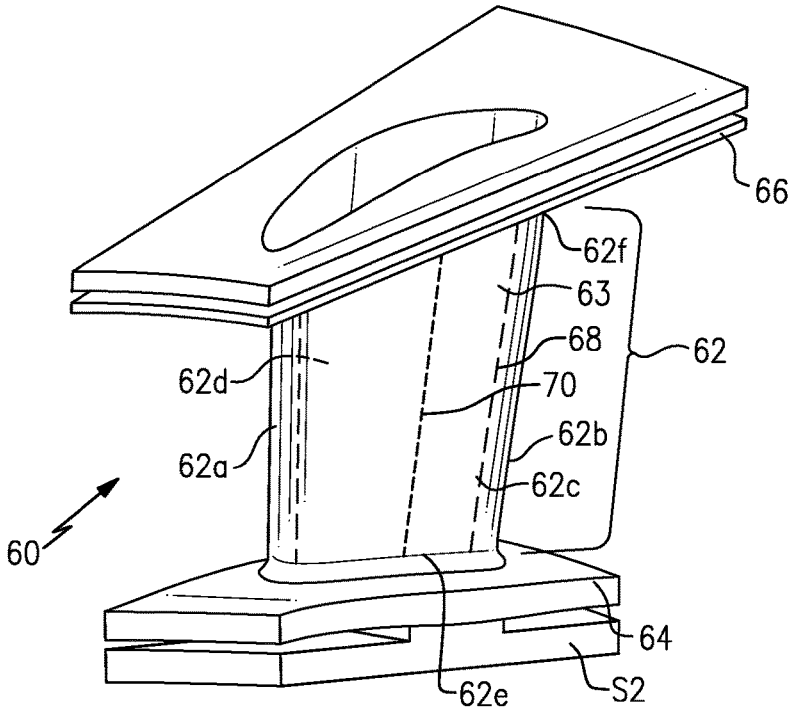
FIG. 2 illustrates an example vane arc segment of the gas turbine engine.

FIG. 2 illustrates a representative example of select portions of a vane arc segment 60 from the turbine section 28 of the engine 20 (see also FIG. 1). It is to be understood that although the examples herein are discussed in context of a vane from the turbine section, the examples are applicable to other cooled vanes that have support spars.

The vane arc segment 60 includes an airfoil section 62 that is formed by an airfoil wall 63. The airfoil section 62 defines a leading edge 62*a*, a trailing edge 62*b*, and first and second sides 62*c*/62*d* that join the leading edge 62*a* and the trailing edge 62*b*. In this example, the first side 62*c* is a pressure side and the second side 62*d* is a suction side. The airfoil section 62 generally extends in a radial direction relative to the central engine axis and spans from a first end 62*e* at an inner or first platform 64 to a second end 62*f* at a second or outer platform 66. The terms "inner" and "outer" refer to location with respect to the central engine axis A, i.e., radially inner or radially outer.

The airfoil wall 63 is continuous in that the platforms 64/66 and airfoil section 62 constitute a one-piece body. As an example, the airfoil wall 63 is formed of a ceramic material, an organic matrix composite (OMC), or a metal matrix composite (MMC). For instance, the ceramic material is a monolithic ceramic or a ceramic matrix composite (CMC) that is formed of ceramic fibers that are disposed in a ceramic matrix. The monolithic ceramic may be, but is not limited to, SiC or other silicon-containing ceramic. The ceramic matrix composite may be, but is not limited to, a SiC/SiC ceramic matrix composite in which SiC fibers are disposed within a SiC matrix. Example organic matrix composites include, but are not limited to, glass fiber, carbon fiber, and/or aramid fibers disposed in a polymer matrix, such as epoxy. Example metal matrix composites include, but are not limited to, boron carbide fibers and/or alumina fibers disposed in a metal matrix, such as aluminum. The fibers may be provided in fiber plies, which may be woven or unidirectional and may collectively include plies of different fiber weave configurations.

The airfoil section 62 circumscribes an interior through-cavity 68. The airfoil section 62 may have a single through-cavity 68 or, as shown, a rib 70 that that divides the interior through-cavity 68 into a forward cavity that is bound by the leading edge 62*a* portion of the airfoil wall 63 and an aft cavity that is bound by the trailing edge 62*b* portion of the airfoil wall 63. It is to be appreciated that the airfoil section 62 may have additional ribs that further divide the through-cavity 68.

Figure 3:
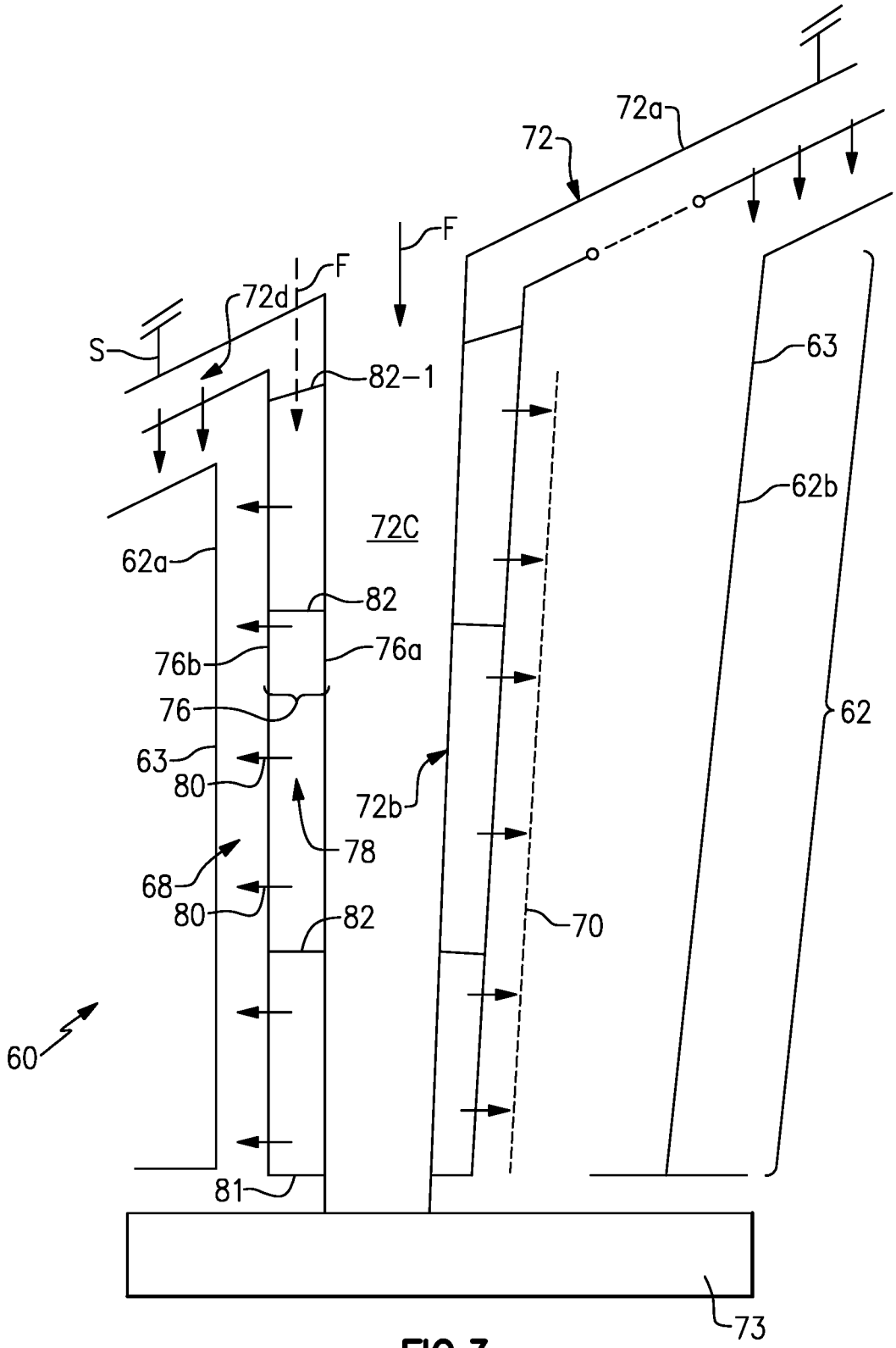
FIG. 3 a line representation of a sectioned view of the vane arc segment.

The airfoil wall 63 is supported by a spar 72 and support hardware 73. FIG. 3 shows a line representation of a sectioned view of the vane arc segment 60 taken in the plane of the chord of the airfoil section 62. The spar 72 includes a spar platform 72*a* and a spar leg 72*b* that extends from the spar platform 72*a* into the through-cavity 68. The spar 72 is generally radially elongated and is secured with structural support S (e.g., a case) and support hardware 73. The spar 72 thereby traps the airfoil wall 63 between the spar platform 72*a* and support hardware 73 to mechanically support the airfoil wall 63 and react out loads, such as aerodynamic loads. In this regard, the spar 72 may be formed of a relatively high temperature resistance, high strength material, such as a single crystal metal alloy (e.g., a single crystal nickel- or cobalt-alloy).

The spar 72 is formed by a spar wall 76 that has inner and outer wall portions 76*a*/76*b*. The wall portions 76*a*/76*b* define a plenum passage 78 there between. The spar wall 76 circumscribes a core passage 72*c*. The inner wall portion 76*a* is solid such that the plenum passage 78 is substantially or fully fluidly isolated from the core passage 72*c*. The outer wall portion 76*b* has a plurality of cooling through-holes, represented by arrows 80. The end 81 of the plenum passage 78 distal from the spar platform 72*a* is closed such that the holes 80 are the exclusive outlets of the plenum passage 78. In inner wall portion 76*a* extends beyond the outer wall portion 76*b* and is secured to the support hardware 73.

Cooling air F, such as bleed air from the compressor section 24, is conveyed into and through the through-passage 72*c* of the spar 72. This cooling air is destined for a downstream cooling location, such as a tangential onboard injector (TOBI). As indicated above, the through-passage 72*c* is substantially or fully isolated from the plenum passage 78. Cooling air F is also conveyed through an inlet into the plenum passage 78 as a source of air for impingement cooling of the airfoil wall 63. As the only exits from the plenum passage 78 are through the holes 80, all of the cooling air in the plenum passage 78 is emitted as impingement cooling onto the airfoil wall 63. For example, the impingement holes 80 are directed toward the leading edge 62*a*. Alternatively or additionally, the cooling holes 78 may be directed toward the pressure side 62*c* and/or suction side 62*d*. As the plenum passage 78 is isolated from the core passage 72*c*, the cooling air F in the core passage 72*c* does not intermix with cooling air in the plenum passage 78. Conversely, there may also be portions in the plenum passage 78 that receive less air flow than other regions. In that case, one or more orifices can be provided through the inner wall portion 76*a*. The orifice or orifices serve as flow sinks that draw cooling air from the plenum passage 78 into the core passage 72*c*, thereby pulling a greater amount of cooling air flow to the region that would otherwise have low flow. In general, however, due to desired flow margins of the cooling air for impingement and film cooling, the core passage 72*c* and the plenum passage 78 will exclude such orifices and be fully fluidly isolated.

In one example, the core passage 72*c* is provided with first pressurized air and the plenum passage 78 is provided with second pressurized air. The first and second pressurized air may differ in Mach number and thus also in pressure. For instance, the Mach number of the first pressurized air is greater than the Mach number of the second pressurized air, e.g., by a factor of 2-3 or more. At the expected Mach number of the first pressurized air, the air in the through-passage 72*c* is of insufficient pressure for impingement cooling. The pressurized air can come from the different sources (e.g., bleed air from different compressor stages) or the same source (same bleed air) that is divided into streams but that vary in pressure due to flow/exit paths.

In general, a leading edge of a turbine vane needs to be cooled. This is challenging in a two-cavity design with a forward spar that carries cooling air that is of insufficient pressure for impingement cooling. However, by substantially or fully isolating the core passage 72*c* from the plenum passage 78 and providing separate cooling air to the plenum passage 78, the leading edge 62*a* portion of the airfoil wall 63 is provided with cooling, while maintaining the ability of the core passage 72*c* to convey cooling air for downstream use.

As discussed above, the spar 72 supports the airfoil wall 63. The spar platform 72*a* and the spar leg 72*b* are thus structural. In this regard, the spar leg 72*b* may be of robust size in order to handle the structural loads. The robust size of the spar leg 72*b* takes up much of the volume of the through-cavity 68 in the airfoil section 62, thus limiting the space available for a baffle to facilitate cooling of the airfoil wall 63. In this regard, rather than a separate baffle, the plenum passage 78 is embedded in the spar wall 76 in order to deliver impingement cooling air to the airfoil wall 63. Although the spar 72 in this example has a single one of the spar legs 72*b*, it is to be appreciated that the spar may have one or more additional spar legs according to any of the examples herein, in which the one or more additional spar legs extend through other portions of the through cavity 68 (which may or may not be divided by ribs).

The spar 72 may be fabricated by investment casting to form the spar wall 76 around an investment skincore that forms the plenum passage 78. A skincore is a thin, low aspect ratio investment casting core that that is typically injection molded from a material that contains ceramic or metal alloy.

As the investment minicore can be virtually any shape, the investment casting process permits the plenum passage 78 to include features that would be difficult or impossible to fabricate in a conventional sheet metal baffle. For example, as shown in FIG. 3, the spar leg 72*b* includes one or more internal ribs 82 in the plenum passage 78 that connect the inner and outer portions 76*a*/76*b* of the spar wall 76. The ribs 82 serve to segregate the plenum passage 78 into two or more zones that provide cooling air to two or more zones of the airfoil wall 63. Thus, the ribs 82 can be used to divide the flow of the cooling air F between the zones in order to tailor the cooling in each of the zones. Moreover, if as in the example in FIG. 3, the spar platform 72*a* has an internal cooling passage 72*d*, one of the ribs 82-1 may segregate the plenum passage 78 from the cooling passage 72*d* such that the passages 72*d*/78 are fluidly isolated from each other. Additional ribs 82-1 may be provided in the internal cooling passage 72*d* in the platform the segregate it into zones. Additionally, as the spar 72 is structural, the ribs 82 also serve to mechanically reinforce the spar leg 72*b*.

Figure 4:
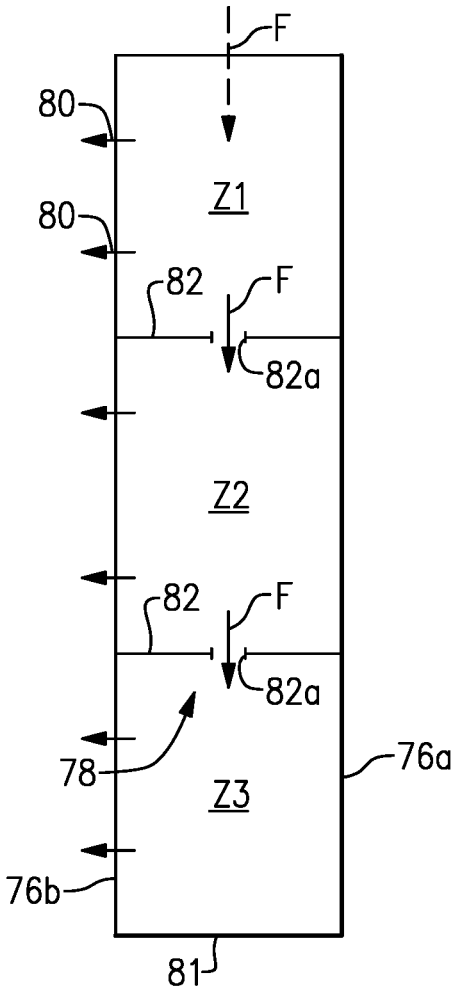
FIG. 4 illustrates a portion of a spar that has ribs that segregate a plenum passage in radial zones.

FIG. 4 illustrates one example in which the ribs 82 segregate the plenum passage 78 into radial zones Z1/Z2/Z3. In this example, the ribs 82 have through-holes 82*a* that serve to regulate flow of the cooling air between the zones Z1/Z2/Z3.

Figure 5:
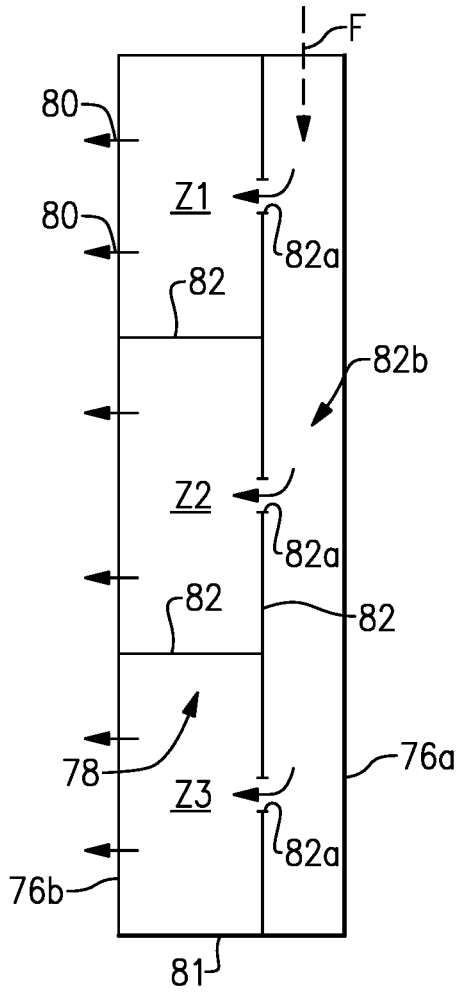
FIG. 5 illustrates a portion of a spar that has ribs that segregate a plenum passage in radial zones and a manifold passage.

FIG. 5 includes a similar example except that the ribs 82 also define a radially elongated manifold passage 82*b* that interconnects the zones Z1/Z2/Z3 via through-holes 82*a*.

Figure 6:
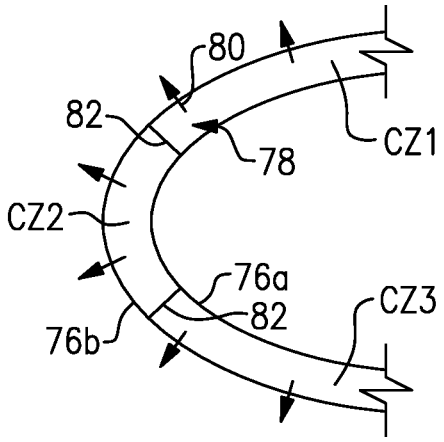
FIG. 6 illustrates a portion of a spar that has ribs that segregate a plenum passage in circumferential zones.

FIG. 6 illustrates another example, in which the view is of the plenum passage 78 radially looking inwards (toward the engine central axis A). In this example, the ribs 82 are radially elongated and segregate the plenum passage 78 into circumferential zones CZ1/CZ2/CZ3. As will be appreciated, the examples herein are not limiting, and various orientations of ribs 82 may be used to provide combinations of radial/circumferential zones and manifold passages.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A spar for a vane arc segment of a gas turbine engine, comprising:

an elongated spar leg having a spar wall that circumscribes a core passage; and a plenum passage embedded in the spar wall between inner and outer portions of the spar wall relative to the core passage, the outer portion of the spar wall having a plurality of cooling through-holes for emitting cooling air from the plenum passage.

2. The spar as recited in claim 1, wherein the inner portion of the spar wall is fully solid such that the plenum passage is fluidly isolated from the core passage, and the plurality of cooling through-holes are exclusive outlets from plenum passage.

3. The spar as recited in claim 1, wherein the elongated spar leg includes ribs in the plenum passage that connect the inner and outer portions of the spar wall.

4. The spar as recited in claim 3, wherein the ribs segregate the plenum passage into radial zones.

5. The spar as recited in claim 3, wherein the ribs segregate the plenum passage into circumferential zones.

6. The spar as recited in claim 3, wherein at least one of the ribs includes a through-hole.

7. The spar as recited in claim 3, further comprising a spar platform from which the elongated spar leg extends, the spar platform having a cooling passage, and one of the ribs segregates the plenum passage from the cooling passage.

8. The spar as recited in claim 3, wherein the ribs segregate the plenum passage into zones and define a manifold passage that interconnects the zones.

9. The spar as recited in claim 1, wherein, in the spar leg, the plenum passage is fluidly isolated from the core passage.

10. The spar as recited in claim 1, wherein an inner surface of the inner portion of the spar wall borders the core passage, an opposed outer surface of the inner portion of the spar wall borders the plenum passage, an inner surface of the outer portion of the spar wall borders the plenum passage, and an opposed outer surface of the outer portion of the spar wall borders neither the plenum passage nor the core passage.

11. A vane arc segment for a gas turbine engine, comprising:

an airfoil section having an airfoil wall defining a leading edge, a trailing edge, a pressure side, and a suction side, the airfoil section having an internal cavity;

a spar extending through the internal cavity for supporting the airfoil section, the spar being spaced from the airfoil wall, the spar having an elongated spar leg including a spar wall that circumscribes a core passage, and a plenum passage embedded in the spar wall between inner and outer portions of the spar wall relative to the core passage, the outer portion of the spar wall having a plurality of cooling through-holes for emitting cooling air from the plenum passage toward the airfoil wall.

12. The vane arc segment as recited in claim 11, wherein the inner portion of the spar wall is fully solid such that the plenum passage is fluidly isolated from the core passage, and the plurality of cooling through-holes are exclusive outlets from plenum passage.

13. The vane arc segment as recited in claim 11, wherein the elongated spar leg includes ribs in the plenum passage that connect the inner and outer portions of the spar wall.

14. The vane arc segment as recited in claim 13, wherein the ribs segregate the plenum passage into radial zones.

15. The vane arc segment as recited in claim 13, wherein the ribs segregate the plenum passage into circumferential zones.

16. The vane arc segment as recited in claim 13, wherein at least one of the ribs includes a through-hole.

17. The vane arc segment as recited in claim 13, further comprising a spar platform from which the elongated spar leg extends, the spar platform having a cooling passage, and one of the ribs segregates the plenum passage from the cooling passage.

18. The vane arc segment as recited in claim 13, wherein the ribs segregate the plenum passage into zones and define a manifold passage that interconnects the zones.

19. The vane arc segment as recited in claim 11, wherein the airfoil wall is ceramic and also includes first and second platforms.

20. The vane arc segment as recited in claim 11, wherein the outer portion of the spar wall is between the airfoil wall and the plenum passage, and the inner portion of the spar wall is between the plenum passage and the core passage.

21. A gas turbine engine comprising:

a compressor section;

a combustor in fluid communication with the compressor section; and a turbine section in fluid communication with the combustor, the turbine section having vane arc segments disposed about a central axis of the gas turbine engine, each of the vane arc segments includes:

an airfoil section having an airfoil wall defining a leading edge, a trailing edge, a pressure side, and a suction side, the airfoil section having an internal cavity, and a spar extending through the internal cavity for supporting the airfoil section, the spar being spaced from the airfoil wall, the spar having an elongated spar leg including a spar wall that circumscribes a core passage, and a plenum passage embedded in the spar wall between inner and outer portions of the spar wall relative to the core passage, the outer portion of the spar wall having a plurality of cooling through-holes for emitting cooling air from the plenum passage toward the airfoil wall.

22. The gas turbine engine as recited in claim 21, wherein the elongated spar leg includes ribs in the plenum passage that connect the inner and outer portions of the spar wall.

23. The gas turbine engine as recited in claim 22, wherein the airfoil wall is ceramic and also includes first and second platforms.

* * * * *